US008973292B1

(12) United States Patent
Shlonsky et al.

(10) Patent No.: US 8,973,292 B1
(45) Date of Patent: Mar. 10, 2015

(54) GREETING CARD WITH PULL STRING CURTAIN

(71) Applicant: American Greetings Corporation, Cleveland, OH (US)

(72) Inventors: Lynne Shlonsky, Shaker Heights, OH (US); Gary Nelson, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/479,345

(22) Filed: Sep. 7, 2014

Related U.S. Application Data

(60) Provisional application No. 61/888,940, filed on Oct. 9, 2013.

(51) Int. Cl.

| | |
|---|---|
| ***B42D 15/00*** | (2006.01) |
| ***G09F 11/02*** | (2006.01) |
| ***B42D 15/02*** | (2006.01) |
| ***B42D 15/04*** | (2006.01) |

(52) U.S. Cl.
CPC ..... *B42D 15/027* (2013.01); *B42D 15/022* (2013.01); *B42D 15/042* (2013.01)
USPC ..... 40/124.03; 40/124.09; 40/421; 40/423

(58) Field of Classification Search
USPC ..... 40/124.01, 124.03, 124.09, 455, 457, 40/463, 466, 470, 421, 423, 411, 414
See application file for complete search history.

(56) References Cited

U.S. PATENT DOCUMENTS

| | | | | |
|---|---|---|---|---|
| 1,735,352 | A * | 11/1929 | Morrison | 40/473 |
| 1,800,948 | A * | 4/1931 | McHugh | 446/82 |
| 2,166,572 | A * | 7/1939 | Staudt | 40/420 |
| 6,192,215 | B1 * | 2/2001 | Wang | 434/307 R |
| 7,634,864 | B2 | 12/2009 | Segan | |

* cited by examiner

*Primary Examiner* — Casandra Davis
(74) *Attorney, Agent, or Firm* — Christine Flanagan

(57) ABSTRACT

An interactive greeting card which contains a moveable object attached to a motor and a sound module operative to store and playback at least one pre-recorded audio file. The moveable object is contained on an inside panel of the greeting card concealed beneath a curtain. The curtain contains a pull string cord which when pulled, opens the curtain revealing the moveable object while also triggering playback of the pre-recorded audio and triggering activation of the motor module, causing movement of the mobile object.

20 Claims, 3 Drawing Sheets

GREETING CARD WITH PULL STRING CURTAIN

RELATED APPLICATIONS

This patent application is a non-provisional of and claims priority to U.S. Provisional Patent Application No. 61/888,940, filed on Oct. 9, 2013. A copy of this provisional application is incorporated herein by reference in its entirety.

FIELD OF THE INVENTION

The present invention is in the field of social expression products and more specifically, interactive greeting cards.

SUMMARY OF THE INVENTION

An interactive greeting card which contains a moveable object attached to a motor and a sound module operative to store and playback at least one pre-recorded audio file. The moveable object is contained on an inside panel of the greeting card concealed beneath a curtain. The curtain contains a pull string cord which when pulled, opens the curtain revealing the moveable object while also triggering playback of the pre-recorded audio and triggering activation of the motor module, causing movement of the mobile object.

DETAILED DESCRIPTION OF PREFERRED AND ALTERNATE EMBODIMENTS

Figure 1:
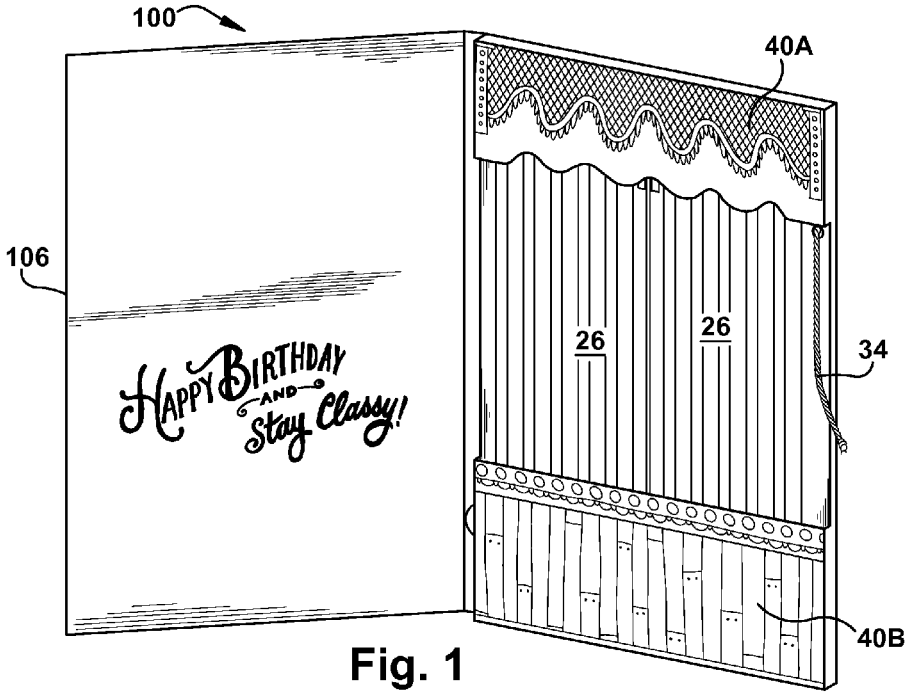
FIG. 1 is a perspective view of the inside of the greeting card of the present invention, with closed curtain.

The interactive greeting card of the present invention contains a multi-paneled greeting card body combined with a sound and motor module and a moveable object located behind a curtain on the inside of the greeting card. When the curtain is moved aside to reveal the moveable object, the sound and motor modules are activated causing the moveable object to move and the sound module to initiate playback of audio.

The greeting card body 10 may contain multiple panels connected along various fold lines. The panels are wrapped around a rectangular form or frame which houses and protects the internal components of the greeting card 100. The frame is substantially rectangular having various cut-outs and spaces where necessary to accommodate the other greeting card components therein. A front surface of the covered frame serves as the inside right panel of the greeting card 100 and the back surface of the covered frame serves as the back cover of the greeting card 100. The portion of the greeting card body which covers the frame is attached along a fold line to another greeting card panel which serves as the greeting card cover panel 10C. The greeting card body 10 may be a single contiguous piece of material (such as paperboard, paper stock, card stock, cardboard, etc.) or it may contain two or more pieces of material that are attached together to form the outer covering of the greeting card 100. It may contain large main panels and smaller, narrow side panels which cover the thickness or perimeter of the greeting card frame. The material is wrapped around the frame and permanently attached thereto, providing a decorative covering printed with text sentiment, artwork, photographs, drawings and the like. The outer covering or body 10 of the greeting card 100 may also contain three dimensional embellishments such as rhinestones, rivets, ribbon, and the like.

As mentioned above, a greeting card frame serves as the internal housing of the electronics and other greeting card components. The frame, in a preferred embodiment, has a substantially rectangular shape with various openings to accommodate the internal components of the greeting card 100. One or more pieces of foam or other cushioning material may be attached to or inserted proximate to the frame which may surround delicate electronics components to prevent them from damage. In a preferred embodiment, the greeting card frame contains an opening proximate to the center of the frame. This opening is positioned to surround a movable object 12 which is attached to the greeting card 100 beneath the front cover of the greeting card. The moveable object 12, in a preferred embodiment, is a die cut shape which is attached to a small motor 14 concealed within the greeting card 100 and covered by the panels of the greeting card body 10. The small motor 14 contains a rotating gear 16 which turns in a circular motion. A portion of the moveable object 12 is attached to this motor 14 via an attachment mechanism 18 so that when the motor 14 is activated, the moveable object 12 begins to move in an up-and-down motion. The motor 14 may alternatively be placed at a different orientation so the movement of the moveable object 12 appears side-to-side as opposed to up and down. Alternatively, a different type of small motor may be used which may affect other types of reciprocal movement. A sound module is also contained within the greeting card and concealed by the panels of the greeting card body 10. The sound module is operative to store and playback at least one audio file. Electronic components included in the greeting card 100 may include a printed circuit board 20, integrated circuit chip, processor, memory, speaker 22, power source 24, such as one or more batteries, and any other component which is known to one having skill in the art as being essential to or to facilitate storage and playback of an audio file and motor activation and movement of a moveable object. Activation of the sound module and motor 14 are controlled by one or more switch mechanisms. In a preferred embodiment, a single switch mechanism is used to control simultaneous playback of the audio file and movement of the moveable object 12 via the motor 14. However, in other embodiments, two separate switches may control activation of the sound module and motor 14.

Figure 2:
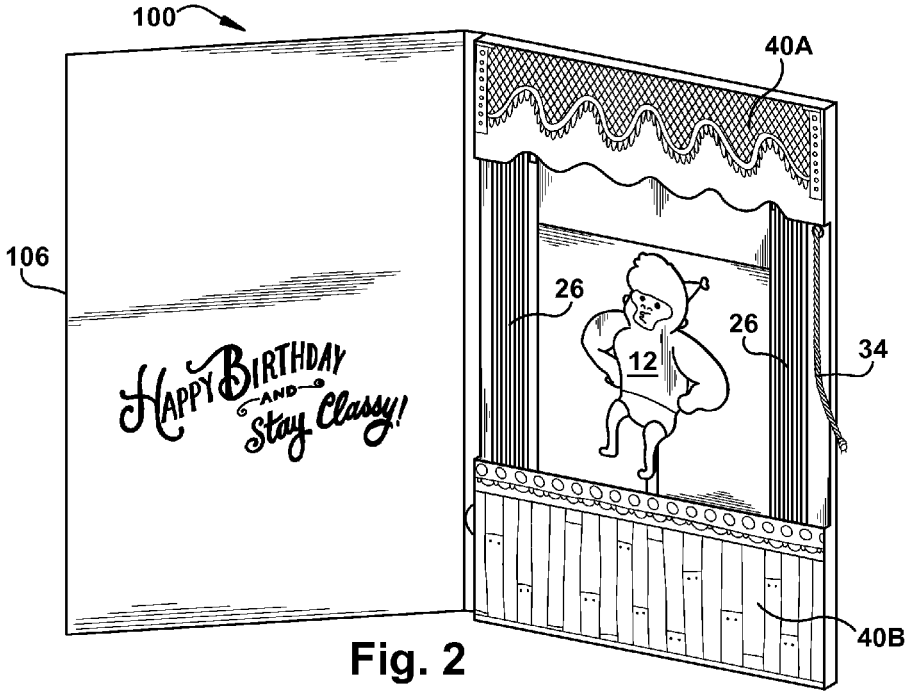
FIG. 2 is a perspective view of the inside of the greeting card of FIG. 1, with open curtain.
Figure 3:
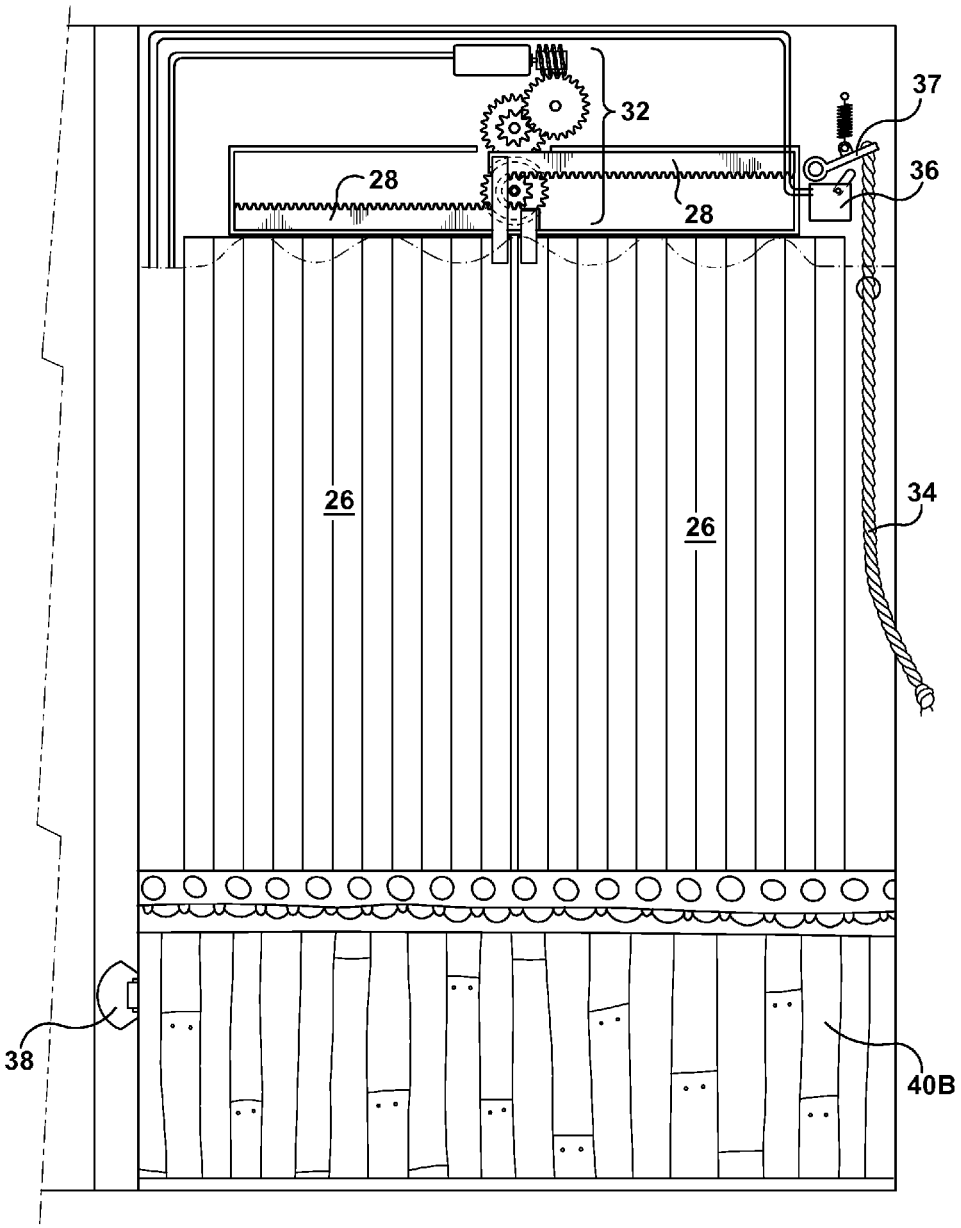
FIG. 3 is a front partial tear-away view of the motor module of the greeting card of FIG. 1.
Figure 4:
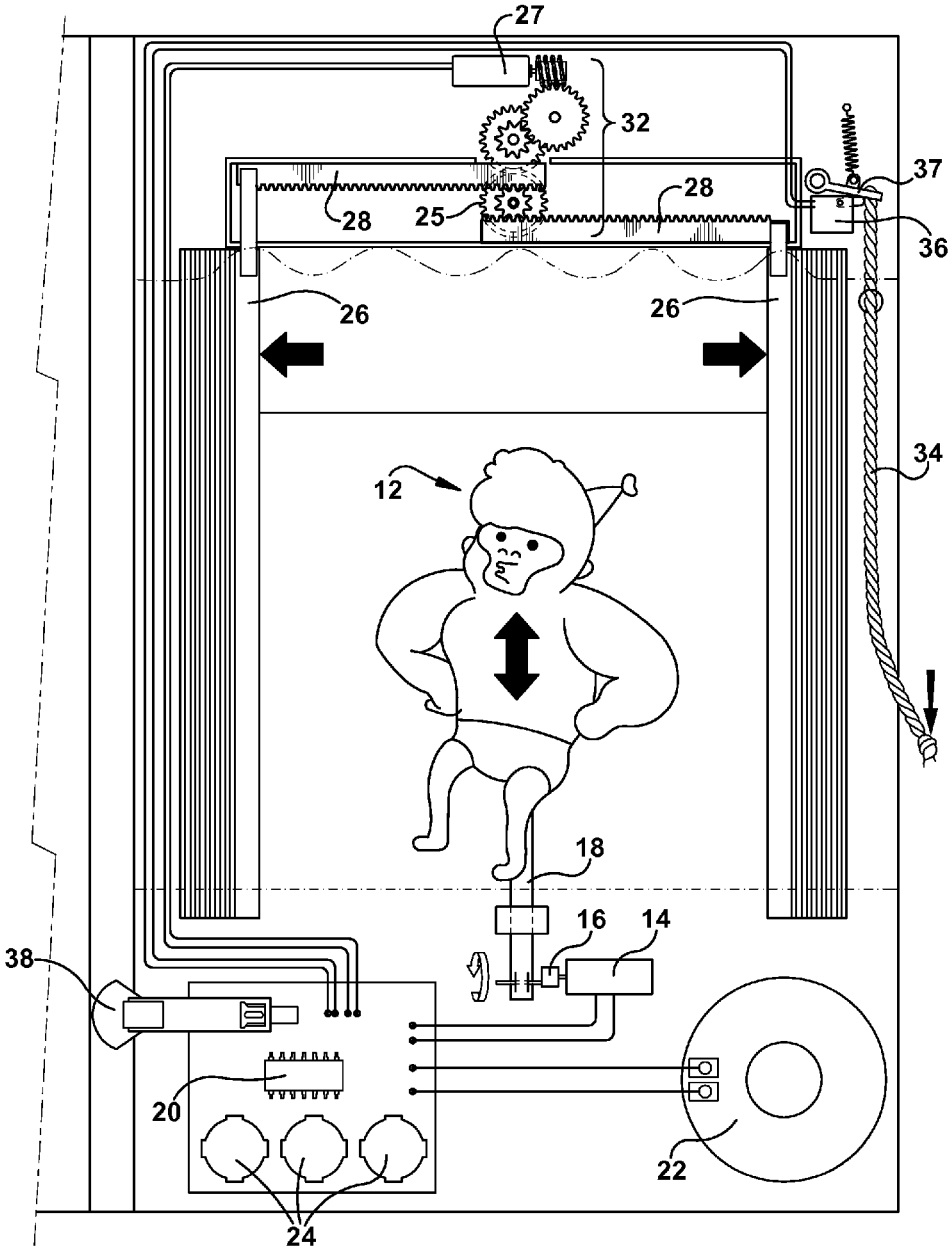
FIG. 4 is a front partial tear-away view of the motor module and electronic components of the greeting card of FIG. 1.

As mentioned above, the greeting card frame contains an opening therein through which the moveable object 12 is located. The opening is covered by a material which represents a curtain 26 covering the opening in the frame. The curtain 26, in a preferred embodiment, includes two separate pieces of cloth or other material which are each independently attached to two separate notched rods 28 which, in combination with a motorized gear apparatus 32, allow the curtains 26 to open and close. The notched rods 28 (to which the curtains are attached) each mesh with an opposite side of a gear 25, which is located equidistant from the right and left sides of the frame. A second motor (when activated) 27 drives the gear 25 such that each notched rod 28 and curtain 26 moves from an open position (wherein each curtain is pushed aside to the left or the right, as shown in FIGS. 2 and 4) and a closed position (wherein each curtain is unfurled or stretched out to cover one half the distance between the two outer edges of the frame, as shown in FIGS. 1 and 3). The curtains 26 may be a shiny fabric material or plush velvet material to resemble theater curtains, however the curtains 26 may be made of any material. Also, in other embodiments the curtain may be a single piece of material which opens to the left or to the right. A pull-cord 34 (also referred to herein as a "pull string mechanism") is attached at one end to a lever 37 and the opposite free end of the pull-cord 34 hangs down along a right edge of the right curtain 26, as shown in the Figures. A small attachment may be connected to the free end of the pull cord 34 to facilitate pulling the curtain 26 to an open position. Pulling downward on the pull-cord 34 activates the switch 36 (by way of the lever 37) which puts the motorized gear mechanism 32 in motion. The motorized gear mechanism 32 causes the two curtains 26 to move away from each other with one curtain moving to the left and the other curtain moving to the right, thereby revealing the moveable object 12 which is beneath the curtain 26. The switch 36 also activates both the sound module and the motor, causing playback of the at least one audio file through the speaker 22 and causing the mobile object 12 to move in an up-and-down or side-to-side motion. This presentation gives the impression that the moveable object 12 is on a stage dancing to the music being replayed by the sound module. Upon closing the greeting card 100, a slide trigger 38 sends a signal to the controller that the greeting card 100 is being closed and to cease operation of the motorized gear mechanism 32 (thereby allowing the curtain to move back into the closed position) and to cease the audio replay. The shape and decoration of the greeting card 100, the shape and decoration of the moveable object 12 and the at least one audio file are each complimentary and coordinated with each other to effect the scene described above. For example, the greeting card 100 may contain printing thereon and may contain additional paperboard (or other material) constructs to resemble a stage or a theater. A rectangular construct 40A can be attached to a top edge of the greeting card frame, above the opening to represent a cornice or decorative molding that may appear above the top portion of a curtain 26. Another rectangular construct 40B may be attached to a lower portion of the greeting card frame below the opening to represent the front face of the stage. These extra constructs 40A, 40B not only further carry out the theme of the greeting card 100, they also make the stage scene look three dimensional. The moveable object 12 may be shaped and printed to resemble any type of performer, human or animal. For example, the die cut shape may resemble a clown, a monkey, a ballerina or a juggler.

In practice, the greeting card recipient would open the greeting card 100 by moving the front cover 10A, 10B away from the greeting card 100. On the inside of the greeting card 100 there may be some printed text sentiment and other artwork, etc. The printed text may instruct the user to open the curtain 26 by pulling on the pull-cord 34. The printed text may be located anywhere on the greeting card 100 or it may be on the pull-cord 34 or to an object attached to the free end of the pull-cord 34. When the user pulls down on the pull-cord 34, the lever 37 activates the motorized gear mechanism 32, causing the curtains 26 to open, revealing the moveable object 12 which is moving or "dancing" to the music which is also being emitted through the speaker 22. The music and movement of the moveable object 12 may continue until the user closes the greeting card 100. When the user closes the greeting card a slide switch 38, located across a fold line adjacent to the front cover of the greeting card 10A, 10B, sends a signal to the controller to cease activation of the motorized gear mechanism 32, thereby closing the curtain 26 and ceasing activation of the motor (ceasing movement of the mobile object) and the audio playback, until the next time the greeting card 100 is opened and the pull-cord 34 is pulled. Alternatively, the music and movement of the moveable object 12 may continue until the audio clip has been exhausted or the sound module and motor 14 may be pre-programmed to remain in the "on" position for a pre-determined period of time.

The greeting card of the present invention has been described herein to set forth a preferred embodiment of the invention. Sizes, materials, location of different openings, etc. are not intended to limit the invention in any way. Variations of these parameters have been contemplated and are considered to be within the scope of the present invention. Any types and number of switch mechanisms can be used to replace or in addition to the switch mechanism described herein with respect to the preferred embodiment. Also, additional effects such as lighting may also be added to the invention.

The invention claimed is:

1. An interactive greeting card comprising:

a multi-panel greeting card body;

a mobile object connected to a motor which is concealed between two or more panels of the multi-panel greeting card body, the motor operative to cause movement of the mobile object;

a sound module operative to store and playback at least one audio file;

a curtain covering a portion of an inside of the greeting card, concealing the mobile object;

a pull-cord which when pulled, opens the curtain revealing the moveable object, activates the motor which causes movement of the moveable object, and activates the sound module triggering playback of the at least one audio file;

wherein closing the greeting card causes the movement of the mobile object and the audio playback to cease and also causes the curtain to close.

2. The interactive greeting card of claim 1, wherein movement of the curtains is controlled by a motorized gear mechanism.

3. The interactive greeting card of claim 1, wherein the mobile object is a die cut shape.

4. The interactive greeting card of claim 1, wherein the mobile object is substantially planar.

5. The interactive greeting card of claim 1, wherein the curtain is two separate pieces of material.

6. The interactive greeting card of claim 1, wherein the pull-cord is attached at one end to a lever which activates a switch upon a user pulling on the pull-cord.

7. An interactive greeting card comprising:

a rectangular frame having four sides and an opening therein;

a multi-panel greeting card which covers the rectangular frame;

a mobile object which is located within the opening on the rectangular frame and attached to a motor module;

the motor module contained within the rectangular frame and concealed by the multi-panel greeting card, the motor module operative to cause movement of the mobile object;

a sound module contained within the rectangular frame and concealed by the multi-panel greeting card, the sound module operative to store and playback at least one audio file;

at least one curtain panel which is moveable between a closed position wherein it conceals the mobile object and an open position wherein it reveals the mobile object;

a pull-string mechanism;

wherein pulling the pull-string mechanism in a downward motion moves the at least one curtain panel into the open position, activates the sound module causing playback of the at least one audio file, and activates the motor module causing movement of the mobile object.

8. The interactive greeting card of claim 7, wherein closing the greeting card moves the at least one curtain panel to the closed position.

9. The interactive greeting card of claim 7, wherein the mobile object is located on an inside surface of the greeting card.

10. The interactive greeting card of claim 7, wherein the at least one curtain panel is attached to a motorized gear mechanism.

11. The interactive greeting card of claim 10, wherein the motorized gear mechanism is activated by pulling on the pull-string mechanism.

12. The interactive greeting card of claim 7, wherein the mobile object is a die cut shape.

13. The interactive greeting card of claim 7, wherein the at least one curtain panel is attached to an outside surface of the rectangular frame.

14. The interactive greeting card of claim 7 further comprising a slide switch which signals a controller when the greeting card is being closed.

15. The interactive greeting card of claim 7, wherein upon closing the greeting card, the curtain is closed and the sound and motor modules are deactivated.

16. An interactive greeting card comprising:

a multi-panel greeting card body;

a mobile object contained on an inside surface of the multi-panel greeting card body;

a motor module which is operative to cause movement of the mobile object;

at least one curtain which is contained on an inside surface of the greeting card, the at least one curtain moveable between a first position wherein it covers the mobile object and a second position wherein it does not cover the mobile object;

a switch which controls activation of the motor module and which causes the at least one curtain panel to move between the first and second positions;

wherein the switch is activated upon user interaction with the greeting card, wherein the switch is a pull string and wherein the switch opens the greeting card.

17. The interactive greeting card of claim 16 further comprising a sound module operative to store and playback at least one audio file.

18. The interactive greeting card of claim 17, wherein activation of the sound module is controlled by the switch.

19. The interactive greeting card of claim 16, wherein the at least one curtain moves from the second position to the first position upon closing the greeting card.

20. The interactive greeting card of claim 16, wherein the motor module is deactivated upon closing the greeting card.

* * * * *